US009695810B2

(12) United States Patent
Kang et al.

(10) Patent No.: US 9,695,810 B2
(45) Date of Patent: Jul. 4, 2017

(54) LINEAR COMPRESSOR

(71) Applicant: LG ELECTRONICS INC., Seoul (KR)

(72) Inventors: Kyoungseok Kang, Seoul (KR); Wonhyun Jung, Seoul (KR); Chulgi Roh, Seoul (KR); Jungwan Heo, Seoul (KR); Sangsub Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 161 days.

(21) Appl. No.: 14/317,217

(22) Filed: Jun. 27, 2014

(65) Prior Publication Data

US 2015/0004028 A1 Jan. 1, 2015

(30) Foreign Application Priority Data

Jun. 28, 2013 (KR) ..... 10-2013-075512
Jun. 28, 2013 (KR) ..... 10-2013-0075514
Oct. 4, 2013 (KR) ..... 10-2013-0118578

(51) Int. Cl.

*F04B 35/00* (2006.01)
*F04B 35/04* (2006.01)
*F04B 39/00* (2006.01)
*F04B 39/12* (2006.01)

(52) U.S. Cl.

CPC ..... *F04B 35/04* (2013.01); *F04B 35/045* (2013.01); *F04B 39/0044* (2013.01); *F04B 39/12* (2013.01); *F04B 2201/0201* (2013.01)

(58) Field of Classification Search

CPC ..... F04B 39/0044; F04B 35/045; F04B 35/04
USPC ..... 417/415, 416, 417
See application file for complete search history.

(56) References Cited

U.S. PATENT DOCUMENTS 3,007,625 A 11/1961 Heinrich
3,143,281 A 8/1964 Heinrich
3,813,192 A 5/1974 Adams
4,027,211 A 5/1977 Omura
4,827,163 A 5/1989 Bhate et al.
4,924,675 A * 5/1990 Higham ..... F04B 35/045 310/15

(Continued)

FOREIGN PATENT DOCUMENTS

CN 1480648 3/2004
CN 1508427 6/2004

(Continued)

OTHER PUBLICATIONS

European Search Report dated Aug. 10, 2015.

(Continued)

*Primary Examiner* — Charles Freay
*Assistant Examiner* — Christopher Bobish
(74) *Attorney, Agent, or Firm* — Ked & Associates, LLP

(57) ABSTRACT

A linear compressor is provided. The linear compressor may include a shell having a refrigerant inlet, a cylinder provided within the shell, a piston that reciprocates within the cylinder to compress a refrigerant, a motor assembly that provides a drive force to the piston, a support provided for the magnet assembly, to support an end of a permanent magnet, and a frame engaged with the cylinder to support the motor assembly, and that includes a contact to absorb impact when the piston collides against the support.

12 Claims, 8 Drawing Sheets

(56) References Cited

U.S. PATENT DOCUMENTS 4,932,313 A 6/1990 Gutknecht
4,937,481 A 6/1990 Vitale
5,559,378 A 9/1996 Oudet et al.
5,693,991 A * 12/1997 Hiterer ..... F02G 1/0435 310/30
5,704,771 A 1/1998 Fujisawa
6,097,125 A * 8/2000 Park ..... H02K 1/34 310/12.16
6,273,688 B1 8/2001 Kawahara
6,328,544 B1 12/2001 Kawahara et al.
6,379,125 B1 4/2002 Tojo
6,398,523 B1 6/2002 Hur et al.
6,413,057 B1 7/2002 Hong
6,435,842 B2 8/2002 Song
6,561,144 B1 5/2003 Muraji
6,575,716 B1 6/2003 Morita et al.
6,666,662 B2 12/2003 Oh
6,755,627 B2 * 6/2004 Chang ..... F04B 35/045 417/417
6,793,470 B2 9/2004 Song
6,863,506 B2 3/2005 Park
6,875,000 B2 * 4/2005 Bae ..... F04B 35/045 417/416
6,894,407 B2 5/2005 Jung
6,994,530 B2 2/2006 Fujisawa et al.
7,288,862 B2 10/2007 Song
7,331,772 B2 2/2008 Jung
7,404,701 B2 7/2008 Kwon
7,478,996 B2 1/2009 Kang
7,537,438 B2 5/2009 Song
7,614,856 B2 * 11/2009 Inagaki ..... F04B 35/045 267/136
7,617,594 B2 11/2009 Hyeon
7,626,289 B2 * 12/2009 Her ..... F04B 35/045 310/12.04
7,649,285 B2 1/2010 Ueda
7,748,963 B2 7/2010 Lee
7,748,967 B2 7/2010 Park
7,775,775 B2 8/2010 Cho
7,901,192 B2 3/2011 Cho
7,922,463 B2 4/2011 Lee
7,934,910 B2 5/2011 Park
8,109,740 B2 2/2012 Kang
8,303,273 B2 11/2012 Kang
8,556,599 B2 10/2013 Lee
2003/0147759 A1 8/2003 Chang
2004/0047750 A1 3/2004 Kim et al.
2004/0061583 A1 4/2004 Yumita
2004/0109777 A1 6/2004 Hur
2004/0145248 A1 7/2004 Jung et al.
2004/0247457 A1 12/2004 Kim et al.
2005/0098031 A1 5/2005 Yoon et al.
2005/0140216 A1 6/2005 Lee
2005/0142007 A1 6/2005 Lee
2005/0214140 A1 9/2005 Lee
2006/0024181 A1 2/2006 Kim
2006/0060196 A1 3/2006 Kim
2006/0145797 A1 7/2006 Muramatsu et al.
2006/0171825 A1 8/2006 Choi
2006/0280630 A1 12/2006 Lee et al.
2007/0009370 A1 1/2007 Kim et al. ..... 417/417
2007/0110600 A1 5/2007 Park
2007/0134108 A1 * 6/2007 Her ..... F04B 35/045 417/417
2007/0166176 A1 7/2007 Kang et al.
2008/0000348 A1 1/2008 Schubert et al.
2009/0101003 A1 4/2009 Kim et al.
2010/0021323 A1 1/2010 Schubert
2010/0260627 A1 10/2010 Kang et al.
2010/0260628 A1 10/2010 Kim
2010/0260629 A1 * 10/2010 Kang ..... F04B 39/0061 417/417
2010/0290936 A1 11/2010 Kang et al.
2010/0316513 A1 12/2010 Lee et al.
2011/0194957 A1 * 8/2011 Kang ..... F04B 35/045 417/415
2013/0004343 A1 1/2013 Cho et al.
2013/0058815 A1 3/2013 Kim
2013/0195613 A1 8/2013 Kim

FOREIGN PATENT DOCUMENTS

CN 1862016 11/2006
CN 101133247 2/2008
CN 101835983 9/2010
CN 203770066 8/2014
CN 203835658 9/2014
CN 203867810 10/2014
CN 203906211 10/2014
CN 203906214 10/2014
CN 203978749 12/2014
EP 2 312 157 4/2011
JP 05-240156 A 9/1993
JP 2000-002181 1/2000
JP 2001-158995 A 6/2001
JP 2002-122072 4/2002
JP 2002-138954 A 5/2002
JP 2006-280156 A 10/2006
JP 2007-291991 11/2007
JP 2010-200522 A 9/2010
JP 2013-015092 A 1/2013
KR WO 2007046608 A1 * 4/2007 ..... F04B 35/045
KR 10-0792460 1/2008
KR 10-2010-0010421 2/2010
KR 10-2010-0112474 10/2010
KR 10-2013-0118464 A 10/2013
KR 10-2013-0118580 A 10/2013
KR 10-2013-0075512 A 10/2014
KR 10-2013-0075514 A 10/2014
WO WO 02077455 A1 10/2002
WO WO 2007/046608 4/2007
WO WO 2012/088571 7/2012

OTHER PUBLICATIONS

European Search Report dated Sep. 7, 2015.
European Search Report dated Sep. 21, 2015.
Korean Office Action dated Oct. 13, 2014 issued in Application No. 10- 2013-0075512.
Korean Office Action dated Oct. 13, 2014 issued in Application No. 10-2013-0075514.
Chinese Patent Certificate dated Aug. 13, 2014 issued in Application No. 201420160887.6 (patented as CN 203770066 U).
Chinese Patent Certificate dated Sep. 17, 2014 issued in Application No. 201420187800.4 (patented as CN 203835658 U).
European Search Report dated Nov. 14, 2014 issued in Application No. 14 16 8916.6.
European Search Report dated Sep. 17, 2015.
European Search Report dated Oct. 2, 2015.
European Search Report dated Oct. 14, 2015.
Chinese Office Action date Dec. 28, 2015.
Chinese Office Action dated Dec. 14, 2015.
Chinese Office Action dated Dec. 25, 2015.
Chinese Office Action dated Dec. 28, 2015.
(3)Chinese Office Actions dated Dec. 30, 2015.
Korean Office Action dated Jul. 24, 2014.
European Search Report dated Sep. 25, 2015.
U.S. Appl. No. 14/280,825, filed May 19, 2014, Devon C. Kramer.
U.S. Appl. No. 14/316,908, filed Jun. 27, 2014, Devon C. Kramer.
U.S. Appl. No. 14/317,172, filed Jun. 27, 2014, Christopher Bobish.
U.S. Appl. No. 14/317,041, filed Jun. 27, 2014, Devon C. Kramer.
U.S. Appl. No. 14/317,218, filed Jun. 27, 2014, Peter John Bertheaud.
U.S. Appl. No. 14/317,120, filed Jun. 27, 2014, Dominick L. Plakkoottam.
U.S. Appl. No. 14/317,336, filed Jun. 27, 2014, Devon C. Kramer.
U.S. Office Action issued in U.S. Appl. No. 14/317,172 dated May 19, 2016.

(56) References Cited

OTHER PUBLICATIONS

U.S. Office Action issued in U.S. Appl. No. 14/317,218 dated May 20, 2016.
U.S. Office Action issued in U.S. Appl. No. 14/317,120 dated Jun. 2, 2016.
European Search Report dated Oct. 12, 2016 issued in Application No. 16172236.8.
Chinese Patent No. 104251196 issued Oct. 5, 2016.
United States Office Action dated Sep. 8, 2016 issued in U.S. Appl. No. 14/317,336.
United States Office Action dated Sep. 30, 2016 issued in U.S. Appl. No. 14/316,908.
United States Office Action dated Oct. 11, 2016 issued in U.S. Appl. No. 14/280,825.
United States Final Office Action dated Oct. 17, 2016 issued in U.S. Appl. No. 14/317,218.
U.S. Office Action dated Dec. 1, 2016 issued in U.S. Appl. No. 14/317,172.
U.S. Office Action dated Dec. 5, 2016 issued in U.S. Appl. No. 14/317,120.
United States Office Action dated Jan. 26, 2017 issued in U.S. Appl. No. 14/317,041.

* cited by examiner

LINEAR COMPRESSOR

CROSS-REFERENCE TO RELATED APPLICATION

The present application claims priority under 35 U.S.C. 119 and 35 U.S.C. 365 to Korean Patent Application No. 10-2013-0075512, filed in Korea on Jun. 28, 2013, No. 10-2013-0075514, filed in Korea on Jun. 28, 2013, and No. 10-2013-0118578, filed in Korea on Oct. 4, 2013, which are hereby incorporated by reference in their entirety.

BACKGROUND

1. Field

A linear compressor is disclosed herein.

2. Background

Generally, a compressor is a mechanical device that increases pressure by compressing air, refrigerant, or a variety of working gases, with power received from a power generating apparatus, such as an electric motor or a turbine. The linear compressor is widely used in home appliances, such as refrigerators or air conditioners, and is also used for various industrial purposes.

The compressor can be categorized mainly into a reciprocating compressor, in which a compression space is defined between a piston and a cylinder, into and from which a working gas, such as a refrigerant, is suctioned and discharged, such that the piston is linearly reciprocated in an interior of the cylinder to compress the refrigerant; a rotary compressor, in which a compression space is defined between an eccentrically-rotating roller and a cylinder, into and from which a working gas, such as a refrigerant, is suctioned and discharged, so that the roller is eccentrically rotated along an inner wall of the cylinder to compress the refrigerant; or a scroll compressor, in which a compression space is defined between an orbiting scroll and a fixed scroll, into and from which a working gas, such as a refrigerant, is suctioned and discharged, so that the orbiting scroll is rotated along the fixed scroll to compress the refrigerant. Among recent reciprocating compressors, linear compressors have been particularly developed, because the linear compressors have a construction in which the piston is directly connected to a linearly-reciprocating drive motor, thus providing improved compression efficiency without suffering mechanical loss due to transformation of motions. The linear compressor may be generally constructed so that the piston in a sealed shell is linearly reciprocated within the cylinder by the linear motor, to draw in refrigerant, compress, and discharge the same.

The linear motor may be so configured that a permanent magnet is positioned between an inner stator and an outer stator, and may be linearly reciprocated by an electromagnetic force between the permanent magnet and the inner (or outer) stator. Accordingly, as the permanent magnet connected with the piston is driven, the piston is linearly reciprocated within the cylinder, thus drawing in refrigerant, compressing, and discharging the same.

FIGS. 1 and 2 are schematic cross-sectional views of a related linear compressor 1. The related art linear compressor 1 of FIGS. 1-2 may include a cylinder 6, a piston 7, which may be linearly reciprocated within the cylinder 6, and a linear motor that provides the piston 7 with a drive force. The cylinder 6 may be fixed by a frame 5. The frame 5 may be integrally formed with the cylinder 6 or fastened thereto by a separate fastening member, for example.

The linear motor may include an outer stator 2 fixed to the frame 5 and arranged to surround the cylinder 6, an inner stator 3 spaced from an inner side of the outer stator 2, and a permanent magnet 10 disposed in a space between the outer stator 2 and the inner stator 3. The outer stator 2 may include a coil 4.

The linear compressor 1 may additionally include a magnet frame 11. The magnet frame 11 may transmit the drive force of the linear motor to the piston 7. The permanent magnet 10 may be mounted on an outer circumference of the magnet frame 11. The linear compressor 1 may additionally include a supporter 8 that supports the piston 7, and a motor cover 9 engaged to a side of the outer stator 2.

A spring (not illustrated) may be engaged between the supporter 8 and the motor cover 9. The spring may have a natural frequency so adjusted to allow the piston 7 to resonate.

The linear compressor 1 may further include a muffler 12 that extends from an interior of the piston 7 to the outside. The muffler 12 may deaden noise generated by refrigerant flow.

With the above-described construction, when the linear motor is driven, the drive assembly, that is, the magnet frame 11, the permanent magnet 10, the piston 7, and the supporter 8 may be integrally reciprocated.

FIG. 1 illustrates the piston 7 at a bottom dead center (BDC) position, at which the refrigerant is not compressed, while FIG. 2 illustrates the piston 7 at a top dead center (TDC) position, at which the refrigerant is compressed. The piston 7 may linearly reciprocate between the BDC and TDC positions.

The reciprocating motion of the drive assembly (7, 8, 10, 11) may be performed under electric control of the linear motor or structural elastic control of the spring. The drive assembly may be controlled so as not to interfere with stationary components in the linear compressor 1, such as, for example, the frame 5, the cylinder 6, or the motor cover 9, during reciprocating motion.

During driving of the linear compressor, an emergency may occur where the drive assembly is out of control or partially not controllable. In such a situation, the drive assembly and stationary components may interfere or even collide against each other.

Accordingly, to ensure reliability of the compressor, the compressor may be so designed that the drive assembly or the stationary components are brought into contact or collision at locations that are less subject to breakage. The locations that are less subject to breakage may be portions of the drive assembly that have relatively greater mass. As an inertial force of a reciprocating object is in proportion to a mass of the object, this means that the possibility of breakage is lower when a colliding portion of the reciprocating object has a relatively greater mass, because the resting portion has a relatively smaller mass, and thus, has less inertial force.

On the other hand, the possibility of breakage increases when the colliding portion of the reciprocating object has a relatively smaller mass, because the resting portion has a relatively greater mass, and thus, has a greater inertial force. Accordingly, the drive assembly may be designed so that the portion with relatively greater mass collides when an emergency occurs.

In the linear compressor 1 according to the related art, a rare earth magnet, for example, a neodymium magnet or ND magnet, may be used as the permanent magnet 10. Although the ND magnet has a relatively high magnetic flux density, due to expensive cost, only a small amount of the magnet is used. Therefore, the permanent magnet 10 is formed to have a low mass.

In contrast, the piston 7 or the supporter 8 has a relatively greater mass among the drive assembly. Accordingly, the related art linear compressor 1 is so designed that when collision has to occur during reciprocating motion of the drive assembly, the piston 7 and the cylinder 6, or the supporter 8 and the motor cover 9 are the first ones to collide.

For example, referring to FIG. 2, when the piston 7 is located at the TDC position, the piston 7 may contact or collide against an end of the cylinder 6, in which case the permanent magnet 10 may be prevented from contacting or colliding with the frame 5 (see "C").

Although not illustrated, in another example, the piston 7 may be at the TDC position, in which case at least a portion of the supporter 8 may be brought into contact with or collide against the motor cover 9, while the permanent magnet 10 may be prevented from contacting or colliding with the frame 5.

According to the related art technologies discussed above, when the ND magnet is used as the permanent magnet, the expensive price of the ND magnet may increase manufacture costs of the linear compressor. Additionally, due to the considerable size of magnetic flux leaking from the ND magnet, operating efficiency of the compressor may deteriorate.

BRIEF DESCRIPTION OF THE DRAWINGS

Embodiments will be described in detail with reference to the following drawings in which like reference numerals refer to like elements, and wherein.

DETAILED DESCRIPTION

Figure 1:
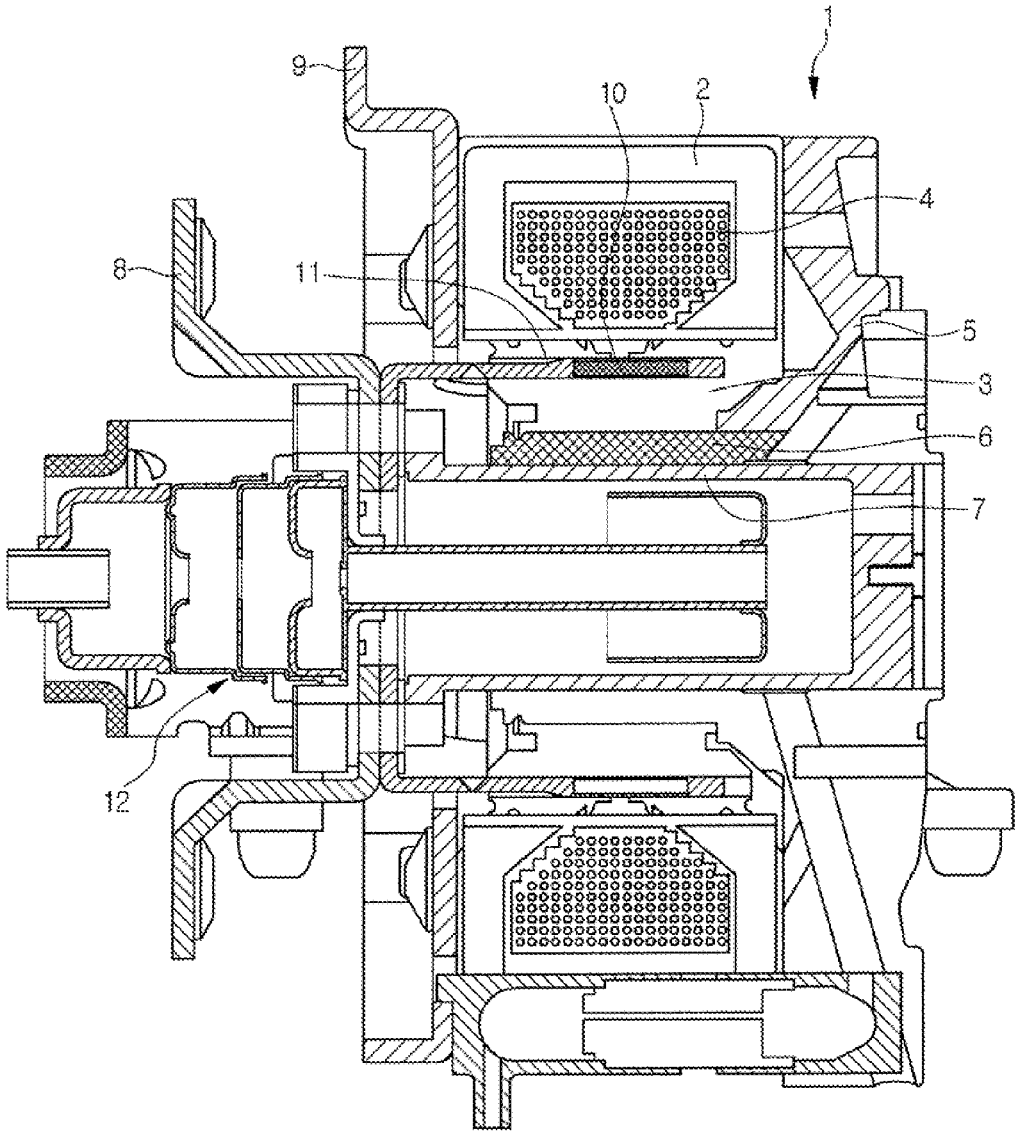
FIGS. 1 and 2 are schematic cross-sectional views of a related compressor.
Figure 2:
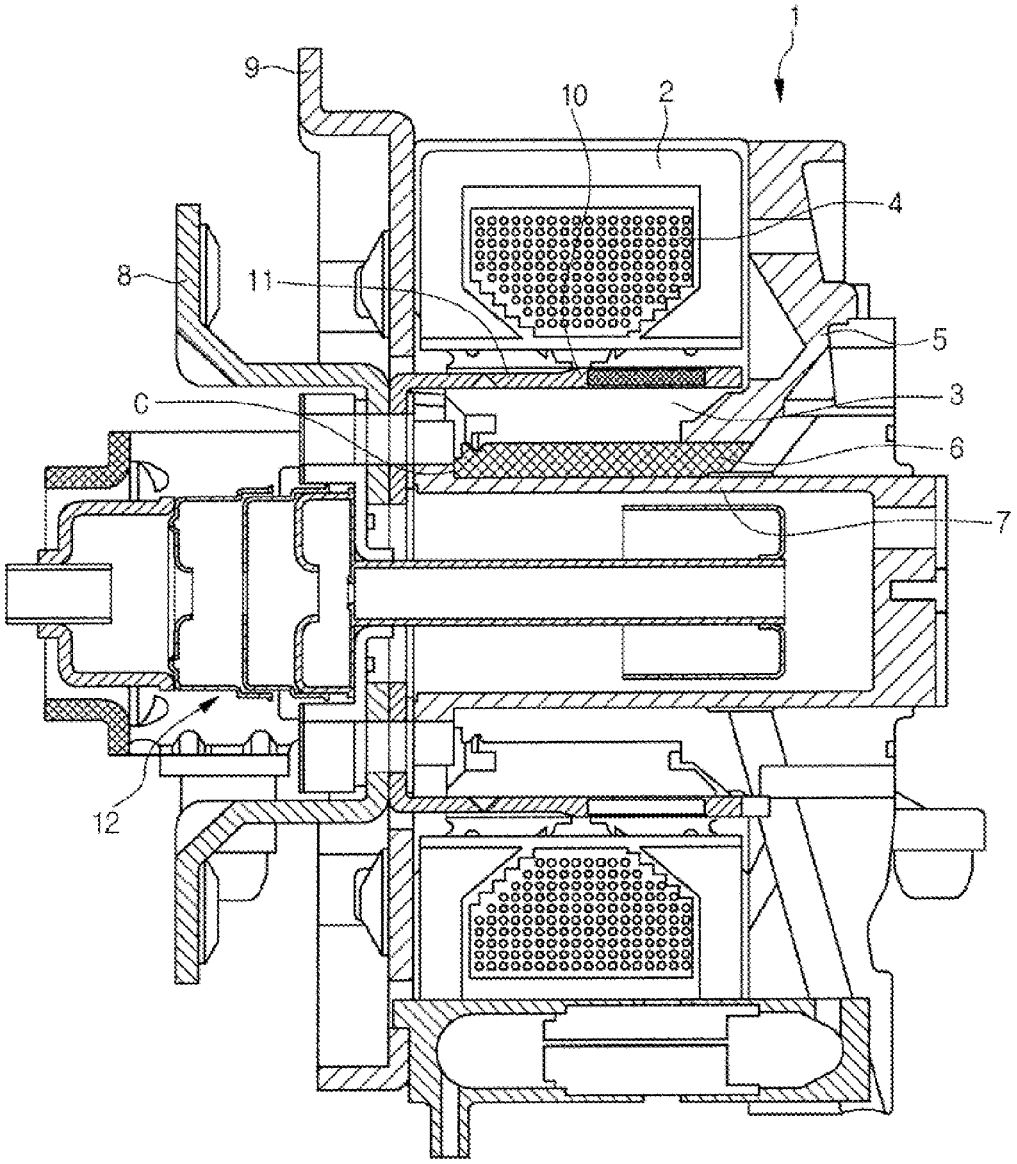

Reference will now be made in detail to the embodiments, examples of which are illustrated in the accompanying drawings. Where possible, like reference numerals have been used to indicate like elements, and repetitive disclosure has been omitted.

A linear compressor according to an embodiment will be described in detail with reference to the accompanying drawings. Embodiment may, however, be embodied in many different forms and should not be construed as being limited to the embodiments set forth herein; rather, that alternate embodiments included in other retrogressive inventions or falling within the spirit and scope of the present disclosure may easily be derived through adding, altering, and changing, and will fully convey the concept of the invention to those skilled in the art.

Figure 3:
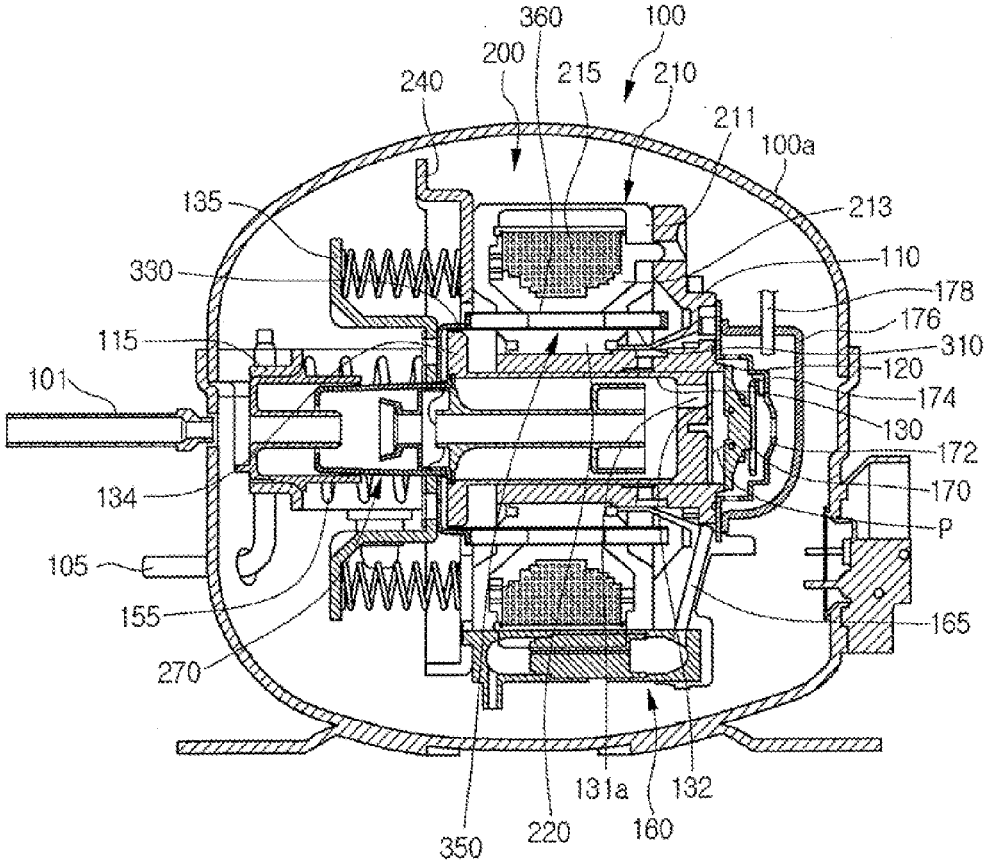
FIG. 3 is a schematic cross-sectional view of a linear compressor according to an embodiment.

FIG. 3 is a schematic cross-sectional view of a linear compressor according to an embodiment. Referring to FIG. 3, the linear compressor 100 according to an embodiment may include a cylinder 120 provided within a shell 100*a*, a piston 130 that linearly reciprocates within the cylinder 120, and a motor assembly 200 that provides the piston 130 with a drive force. The shell 100*a* may include an upper shell and a lower shell engaged with each other.

The cylinder 120 may be formed of a non-magnetic aluminum material, for example, aluminum or aluminum alloy. The cylinder 120 formed of aluminum material may thus prevent magnetic flux generated at the motor assembly 200 from being transmitted to the cylinder 120 and leaking out of the cylinder 120. The cylinder 120 may be an ejector pin cylinder 120, which may be formed by ejector pin processing, for example.

The piston 130 may be formed of non-magnetic aluminum material, for example, aluminum or aluminum alloy. The cylinder 120 formed of non-magnetic aluminum material may thus prevent magnetic flux generated at the motor assembly 200 from being transmitted to the piston 130 and leaking out of the piston 130. The piston 130 may be formed by forge welding, for example.

Component ratios of the cylinder 120 and the piston 130, that is, types and compositions of the cylinder 120 and the piston 130 may be identical. As the piston 130 and the cylinder 120 may be formed of a same material, for example, aluminum, the piston 130 and the cylinder 120 may have a same thermal expansion coefficient. During operation of the linear compressor 100, a high temperature environment (approximately, 100℃) may be formed within the shell 100*a*, in which both the piston 130 and the cylinder 120 with the same thermal expansion coefficient may undergo a same amount of thermal deformation. Accordingly, as thermal deformation to different sizes or in directions may be prevented, the piston 130 may be prevented from interference with the cylinder 120 during movement thereof.

The shell 100*a* may include an inlet 101, into which a refrigerant may be drawn, and an outlet 105, through which the refrigerant, which may be compressed within the cylinder 120, may be discharged. The refrigerant may be thus drawn in through the inlet 101, pass through a suction muffler 270, and move into the piston 130.

The refrigerant drawn in through the inlet 101 may pass through the suction muffler 270, and move into the piston 130. Noise at a variety of frequencies may be reduced as the refrigerant passes through the suction muffler 270.

The cylinder 120 may have a compression space P defined therein, in which a refrigerant may be compressed by the piston 130. The piston 130 may include a suction port 131*a*, through which the refrigerant may be drawn into the compression space P, and a suction valve 132 formed at a side of the suction port 131*a*, to selectively open the suction port 131*a*.

A discharge valve assembly 170, 172, and 174 may be provided at a side of the compression space P to discharge the refrigerant compressed in the compression space P. The compression space P may be a space defined between an end of the piston 130 and the discharge valve assembly 170, 172, and 174.

The discharge valve assembly 170, 172, and 174 may include a discharge cover 172, which may form a refrigerant discharge space, a discharge valve 170, which may open when a pressure of the compression space P exceeds a discharge pressure, to thus permit the refrigerant to be introduced into the discharge space, and a valve spring 174 provided between the discharge valve 170 and the discharge cover 172 to provide an elastic force in an axial direction. The expression "axial direction" may refer to a direction in which the piston 130 reciprocates, or a transversal direction when referring to FIG. 3.

The suction valve 132 may be formed on or at a first side of the compression space P, and the discharge valve 170 may be provided on or at a second side of the compression space P, that is, opposite to the suction valve 132. During linear reciprocation of the piston 130 within the cylinder 120, when the pressure of the compression space P is lower than the discharge pressure and below a suction pressure, the suction valve 132 may open, thus letting the refrigerant be drawn into the compression space P. In contrast, when the pressure of the compression space P exceeds the suction pressure, with the suction valve 132 located in a closed state, the refrigerant in the compression space P may be compressed.

When the pressure of the compression space P exceeds the discharge pressure, the valve spring 174 may deform, thus opening the discharge valve 170. Accordingly, refrigerant may be discharged from the compression space P and be introduced into the discharge space of the discharge cover 172.

The refrigerant in the discharge space may pass through a discharge muffler 176 and be introduced into a loop pipe 178. The discharge muffler 176 may reduce noise from the flow of compressed refrigerant, and the loop pipe 178 may guide the compressed refrigerant to the outlet 105. The loop pipe 178 may be engaged with the discharge muffler 176, and bent and extended to be engaged with the outlet 105.

The linear compressor 10 may additionally include a frame 110. The frame 110 may be integrally formed with the cylinder 120 or fastened with the cylinder 120 by a separate fastening member, for example.

The discharge cover 172 and the discharge muffler 176 may be engaged with the frame 110. The frame 110 may be positioned at a back of a permanent magnet 350.

The motor assembly 200 may include an outer stator 210 fixed or supported on the frame 110 to surround the cylinder 120, an inner stator 220 spaced from an inner side of the outer stator 210, and the permanent magnet 350, which may be positioned in a space between the outer stator 210 and the inner stator 220. The permanent magnet 350 may be linearly reciprocated by the electromagnetic force between the outer stator 210 and the inner stator 220. The permanent magnet 350 may include one pole or three poles. The permanent magnet 350 may be formed of ferrite material, which is relatively inexpensive.

The permanent magnet 350 may be mounted on an outer circumference of a magnet frame 310 of a magnet assembly 300, and a fixing plate 330 may be in contact with an end of the permanent magnet 350. The permanent magnet 350 and the fixing plate 330 may be fixed with each other by a fixing member 360, for example.

The fixing plate 330 may be formed of a non-magnetic material. For example, the fixing plate 330 may be formed of a stainless steel material.

The fixing plate 330 may cover an end of the magnet frame 310, which may be open, and may be fixed to a flange 134 of the piston 130. For example, the fixing plate 330 and the flange 134 may be fastened by a bolt.

The flange 134 may be understood to be a structure that radially extends from an end of the piston 130, and may approach close to an end of the cylinder 120 or move away from the end of the cylinder 120 during reciprocating motion of the piston 130.

According to linear movement of the permanent magnet 350, the piston 130, the magnet frame 310, and the fixing plate 330 may linearly reciprocate along with the permanent magnet 350 in the axial direction.

The outer stator 210 may include a bobbin 213, a coil 215, and a stator core 211. The coil 215 may be wound circumferentially around the bobbin 213. The coil 215 may have a polygonal cross section, such as, for example, a hexagonal cross section. The stator core 211 may include a plurality of laminations stacked in a circumferential direction, surrounding the bobbin 213 and the coil 215.

With application of electric current to the motor assembly 200, electric current may flow along the coil 215, and magnetic flux may be formed around the coil 215 due to the electric current flowing through the coil 215. The magnetic flux may flow along the outer stator 210 and the inner stator 220, forming a closed circuit. The force to move the permanent magnet 230 may be generated as a result of interaction between the magnetic flux flowing in the outer stator 210 and the inner stator 220, and the magnetic flux of the permanent magnet 230.

A stator cover 240 may be provided on or at a side of the outer stator 210. A first end of the outer stator 210 may be supported on the frame 110, while a second end may be supported on the stator cover 240. The stator cover 240 may be referred to as a "motor cover".

The inner stator 220 may be fixed to an external circumference of the cylinder 120, on an inner side of the magnet frame 310. The inner stator 220 may include a plurality of laminations which are stacked on an outer side of the cylinder 120 in a circumferential direction.

The linear compressor 10 may additionally include a supporter 135, which may support the piston 130, and a back cover 115 which may extend from the piston 130 toward the inlet 101. The supporter 135 may be engaged with an outer side of the fixing plate 330. The back cover 115 may be arranged as to cover at least a portion of the suction muffler 140.

The linear compressor 100 may include a plurality of springs 151, 155, which may be elastic members of an adjusted natural frequency to allow resonance movement of the piston 130. The plurality of springs 151, 155 may include a plurality of first springs 151 supported between the supporter 135 and the stator cover 240, and a plurality of second springs 155 supported between the supporter 135 and the back cover 115. The plurality of first and second springs 151, 155 may have identical modulus of elasticity.

The plurality of first springs 151 may be provided above or below the cylinder 120 or the piston 130, and the plurality of second springs 155 may be provided at a front of the cylinder 120 or the piston 130. The term "front" as used herein may refer to a direction from the piston 130 to the inlet 101, and the term "back" may refer to a direction from the inlet 101 toward the discharge valve assembly 170, 172, and 174. The above expressions may be identically used throughout the description.

The shell **100*a* may store a predetermined amount of oil in or on an inner bottom surface thereof. The shell 100*a* may also be provided with an oil feeder 160 on or at a lower portion thereof, to pump oil. The oil feeder 160 may pump up the oil, by being operated in response to vibration generated from linear reciprocating motion of the piston 130**.

The linear compressor 100 may additionally include an oil feed pipe 165 to guide a flow of oil from the oil feeder 160. The oil feed pipe 165 may extend from the oil feeder 160 to a space between the cylinder 120 and the piston 130. When pumped from the oil feeder 160, the oil may pass through the oil feed pipe 165 and be fed to the space between the cylinder 120 and the piston 130, for cooling and lubricating purposes.

Figure 4:
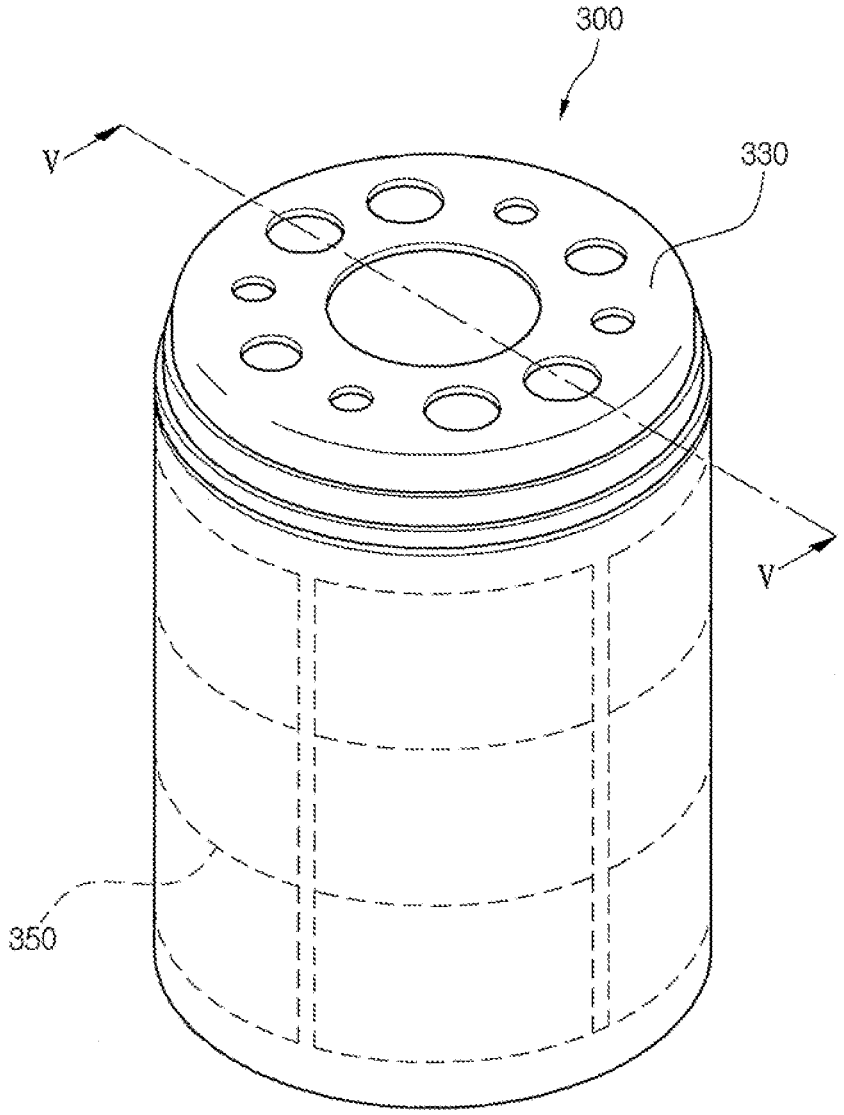
FIG. 4 is a perspective view of a magnet assembly of a linear compressor according to an embodiment.
Figure 5:
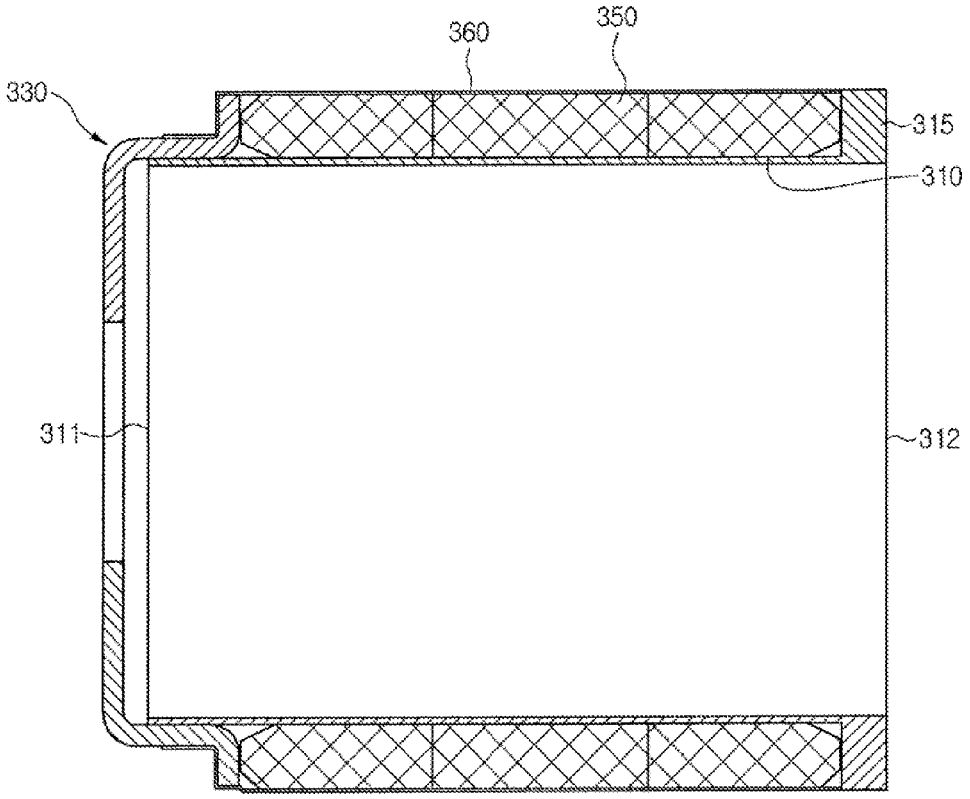
FIG. 5 is a cross-sectional view of the magnet assembly of FIG. 4, taken along line V-V of FIG. 4.

FIG. 4 is a perspective view of a magnet assembly of a linear compressor according to an embodiment. FIG. 5 is a cross-sectional view of the magnet assembly of FIG. 4, taken along line V-V of FIG. 4.

Referring to FIGS. 4 and 5, the magnet assembly 300 according to an embodiment may include magnet frame 310, which may be in an approximately cylindrical shape, and permanent magnet 350 provided on outer circumference of the magnet frame 310. The inner stator 220, the cylinder 120, and the piston 130 may be arranged on or at an inner side of the magnet frame 310, while the outer stator 210 may be arranged on or at an outer side of the magnet frame 310 (see FIG. 3).

Openings 311, 312 may be formed on or at first and second ends of the magnet frame 310. The openings 311, 312 may include a first opening 311 formed on the first end of the magnet frame 310, and a second opening 312 formed on the second end of the magnet frame 310. For example, the first end of the magnet frame 310 may be an "upper end", while the second end of the magnet frame 310 may be a "lower end".

The fixing plate 330 may be fixed to the magnet frame 310, and to the flange 134 of the piston 130. More particularly, the fixing plate 330 may be fixed to the first end of the magnet frame 310 to cover the first opening 311.

A support 315 may be provided on or at an outer circumference of the magnet frame 310 to support the permanent magnet 350. The support 315 may contact a first end of the permanent magnet 350, and may be arranged outside of the second opening 312.

A second end of the permanent magnet 350 may be arranged to contact the fixing plate 330. That is, the permanent magnet 350 may be arranged as to extend between the fixing plate 330 and the support 315. Accordingly, separation of the permanent magnet 350 from the magnet frame 310 may be prevented by the fixing plate 330 and the support 315.

Figure 6:
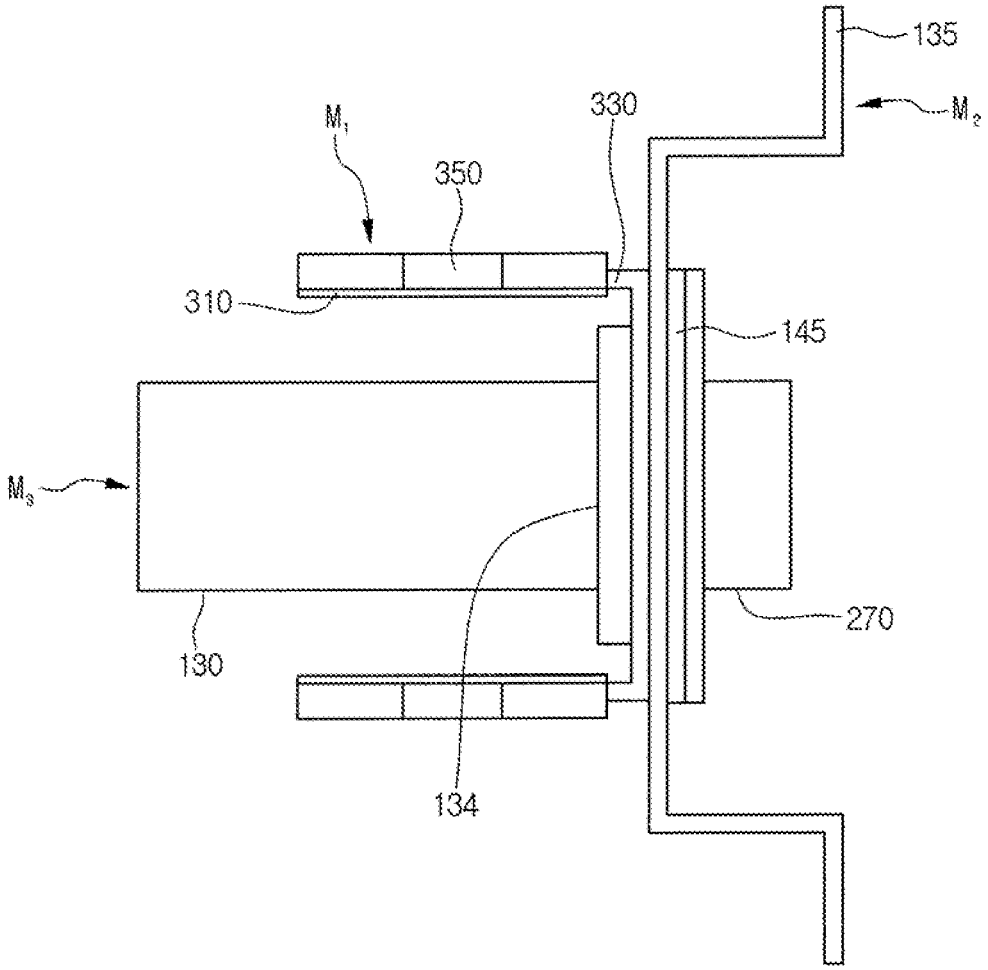
FIG. 6 is a schematic view illustrating a configuration and mass of a drive assembly according to an embodiment.

FIG. 6 is a schematic view illustrating a configuration and mass of the drive assembly according to an embodiment. Referring to FIG. 6, the drive assembly according to an embodiment may include the magnet assembly 300, a piston assembly 130, 134, 145, 270, and the supporter 135.

The magnet assembly 300 may include the magnet frame 310, the permanent magnet 350, and the fixing plate 330. The piston assembly 130 may include the piston 130, the flange 134, a balance weight 145, and the suction muffler 270.

The magnet assembly 300 may have a first mass M1, and the supporter 135 may have a second mass M2. The piston assembly 130, 145, 270 may have a third mass M3.

As discussed above, the masses of the drive assembly may be divided into the first, second, and third masses M1, M2 and M3, depending on whether an impact is directly exerted or an inertial force is applied by the impact, when the drive assembly collides against stationary components, such as, for example, the frame 110, the cylinder 120, or the stator cover 240, in the linear compressor 100, during linear reciprocation of the drive assembly in forward and backward directions. For example, when a portion of the magnet assembly 300 collides against an end of the permanent magnet 350, the impact may be directly transmitted to the components of the magnet assembly 300, and the piston assembly 130 and the supporter 135 may be subject to inertial force.

In contrast, when a portion of the piston assembly 130, 134, 145, 270 collides against the flange 134, the inertial force may be applied to the magnet assembly 300 and the supporter 135. When the supporter 135 collides, the magnet assembly 300 and the piston assembly 130, 134, 145, 270 will be subject to inertial force.

Among the masses of the drive assembly, the first mass M1 of the magnet assembly 300 may be greater than the rest, that is, greater than the second mass M2 of the supporter 135 and the third mass M3 of the piston assembly 130. The second mass M2 may be greater than the third mass M3.

Accordingly, in one embodiment, as the magnet assembly 300 has the greatest mass among the drive assembly collide against predetermined stationary components, when an emergency occurs (that is, when the drive assembly is out of control or not completely controllable), the aim, to prevent separation or breakage of the supporter 135 or the piston assembly 130, 134, 145, 270 due to inertial force, may be achieved.

Hereinafter, structure of the linear compressor according to embodiments will be explained with reference to FIGS. 7 and 8, in which the magnet assembly 300 collides against the frame 110.

Figure 7:
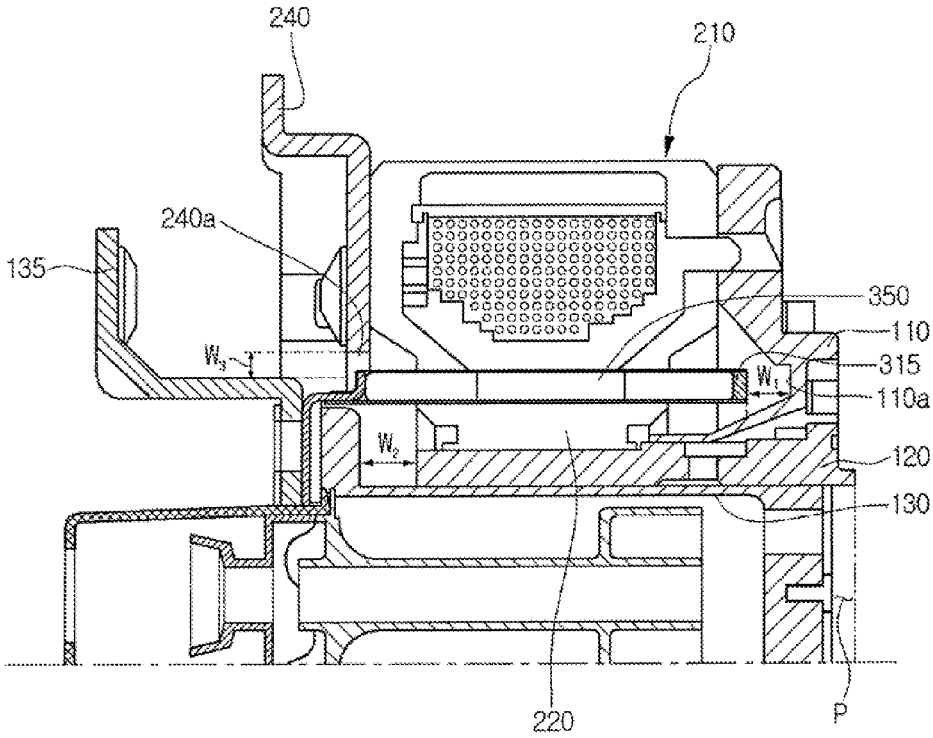
FIG. 7 is a partial cross-sectional view of a linear compressor, when a piston is at a first position, according to an embodiment.

FIG. 7 is a partial cross-sectional view of a linear compressor, when a piston is at a first position, according to an embodiment. FIG. 8 is a partial cross-sectional view of a linear compressor, when a piston is at second position, according to an embodiment.

FIG. 7 illustrates interior of the compressor 100, when the piston 130 is at a first position, according to an embodiment. The term "first position" as used herein may refer to a bottom dead center (BDC) position of the piston 130, which may be a front-most position to which the piston 130 may move. With the piston 130 is at the BDC position, refrigerant may be drawn into the compression space P formed in front of the piston 130.

When the piston 130 is at the BDC position, a rear end of the permanent magnet 350, that is, the support 315 may be at a first distance W1 away from the frame 110. A portion of the frame 110 at the distance W1 from the support member 315 may form a contact 110*a*. The contact 110*a* may be formed at a location where an imaginary line that extends from the permanent magnet 135 meets the frame 110.

The piston 130 and the flange 134 may be at a second distance W2 away from a front end of the cylinder 120. At least a portion of the supporter 135 may be at a third distance W3 away from an imaginary line that extends from an end of the stator cover 240 in forward and backward directions. The "at least a portion" of the supporter 135 as used herein may refer to an extension of the supporter 135 in forward and backward directions.

That is, when the piston 130 is at the BDC position, the drive assembly 134, 135, and 350 may not contact, or collide against the stationary components inside the compressor, such as, for example, the frame 110, the cylinder 120, or the stator cover 240.

The first and second distances W1 and W2 may refer to distances in forward and backward directions, and the third distance W3 may refer to a distance in a radial direction. The first distance W1 may be less than the second distance W2.

Accordingly, when the drive assembly moves backward, and when a traveling distance of the drive assembly is the first distance W1, the end of the permanent magnet 350 may contact or collide against the contact 110*a*. In contrast, the flange 134 of the piston 130 may not contact or collide against the cylinder 120.

Figure 8:
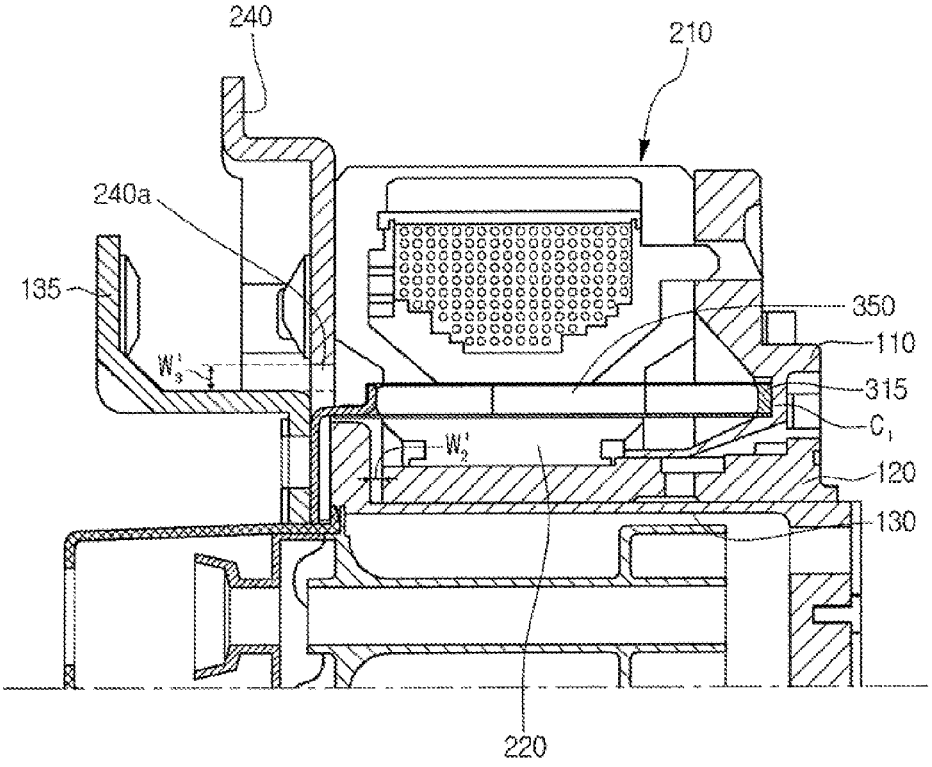
FIG. 8 is a partial cross-sectional view of a linear compressor, when a piston is at a second position, according to an embodiment.

More particularly, FIG. 8 illustrates an interior of the compressor 100, when the piston 130 is at a second position, according to an embodiment. The "second position" as used herein may refer to the top dead center (TOG) portion of the piston 130, which may be a back-most position to which the piston 130 may move. At the TOG position, the refrigerant of the compression space P may be discharged to the discharge cover 172.

When the piston 130 is at the TDC position, a rear end of the permanent magnet 350, that is, the support 315 may collide against the contact 110*a* of the frame 110. That is, the rear end of the permanent magnet 350 and the contact 110*a* may have no space therebetween, and contact point C1 may be formed between the end of the permanent magnet 350 and the contact 110*a*.

Further, the flange 134 of the piston 130 may not contact or collide against the cylinder 120. That is, the flange 134 of the piston 130 may be at a fourth distance W2' away from a front end of the cylinder 120. The fourth distance W2' may be less than the second distance W2.

The supporter 135 may not contact or collide against the stator cover 240. That is, at least a portion of the supporter 135 may be at a fifth distance W3' away from an imaginary line that extends from the end of the stator cover 240 in forward and backward directions. The fifth distance W3' may be equal to, or less than the third distance W3.

As discussed above, when the piston 130 is at the TDC position, among the drive assembly, an end of the permanent magnet 350 may collide against the frame 110, while the supporter 135 and the flange 134 of the piston 130 may not contact or collide against the stator cover 240 and the cylinder 120, respectively.

According to embodiments discussed above, when an emergency occurs in which the compressor is out of control or partially uncontrollable, the magnet assembly, which has a relatively greater mass among the drive assembly, may be brought into contact with the frame 110. As a result, other components may be prevented from breaking due to inertial force.

According to various embodiments disclosed herein, as the permanent magnet is formed of a ferrite material, the permanent magnet has smaller magnetic flux density compared to the conventional ND magnet, and accordingly, has reduced magnetic flux leakage out of the permanent magnet. Accordingly, efficiency of operation of the compressor may be improved. Further, as the permanent magnet is formed of ferrite, which has a more reasonable cost, manufacturing cost for the compressor may be reduced.

Further, in the case of an emergency, as the magnet assembly, which has a relatively greater mass than the rest of the drive assembly, may contact, or collide against stationary components during reciprocating motion, breakage of the drive assembly or the stationary components may be prevented. Furthermore, as the cylinder and the piston may be formed of a non-magnetic material, such as an aluminum material, leakage of magnetic flux generated at the motor assembly out of the cylinder may be prevented, and as a result, efficiency of the compressor may improve.

Embodiments disclosed herein provide a linear compressor with improved compression efficiency and guaranteed reliability.

Embodiments disclosed herein provide a linear compressor that may include a shell, which may include a refrigerant suction part or inlet; a cylinder provided within the shell; a piston that reciprocates within the cylinder; a motor assembly that provides a drive force for a motion of the piston; a support member provided to the magnet assembly, to support an end of the permanent magnet; and a frame, which may be engaged with the cylinder to support the motor assembly, and which may include a contact part or contact to absorb impact when the piston collides against the support member. When the piston is at a first position during a reciprocating motion thereof, the support member may be arranged at a first distance away from the contact part. The first position may be a bottom dead center (BDC) of the piston, and at the BDC of the piston, refrigerant may be drawn in though the refrigerant suction part to be introduced into the cylinder.

When the piston is at a second position during the reciprocating motion thereof, the support member may contact or collide against the contact part. The second position may be a top dead center (TDC) of the piston, and at the TDC of the piston, refrigerant compressed within the cylinder may be discharged out of the cylinder.

The magnet assembly may further include a cylindrical magnet frame, and a fixing plate fixed to a side of the magnet frame, and engaged with one end of the permanent magnet. The linear compressor may further include a flange that extends externally in a radial direction of the piston. The flange may approach closer to an end of the cylinder or move away from the end of the cylinder, during the reciprocating motion of the piston.

When the piston is at the first position, the flange may be at a second distance away from the end of the cylinder, and the first distance may be less than the second distance. When the piston is at the second position, the flange may be at a fourth distance away from the end of the cylinder, and the fourth distance may be less than the second distance.

The linear compressor may additionally include a supporter engaged to an outer side of a flange of the piston, to support the piston, a motor cover that supports one side of the motor assembly, and a spring provided between the supporter and a motor cover. When the piston is at the first position, at least part or portion of the supporter and the motor cover may be at a third distance from each other in radial direction. When the piston is at the second position, at least part or portion of the supporter and the motor cover may be at a fifth distance from each other in the radial direction, and the fifth distance may be equal to, or less than the third distance.

The contact part may be formed at a location where an imaginary line extended from the permanent magnet meets the frame. The permanent magnet may be formed of a ferrite material.

Although embodiments have been described with reference to a number of illustrative embodiments thereof, it should be understood that numerous other modifications and embodiments may be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a shell having a refrigerant inlet;

a cylinder provided within the shell;

a piston that reciprocates within the cylinder to compress a refrigerant;

a motor assembly that provides a drive force to the piston;

a spring support that supports the piston;

a motor cover at an intake end of the cylinder that supports a first side of the motor assembly;

a spring provided between the spring support and the motor cover;

a magnet assembly that delivers the drive force exerted by the motor assembly to the piston and that includes a permanent magnet and a support that supports a first end of the permanent magnet; and a frame engaged with the cylinder at a discharge end of the cylinder to support a second side of the motor assembly, wherein a drive assembly includes the piston, the spring support, and the magnet assembly, wherein the magnet assembly is configured to have a relatively greater mass than the piston or the spring support, wherein the permanent magnet is formed of ferrite material, wherein the piston is formed of an aluminum material, and wherein the frame includes a contact that collides directly with the support of the magnet assembly.

2. The linear compressor according to claim 1, wherein, when the piston is at a first position during a reciprocating motion thereof, the support of the magnet assembly is arranged at a first distance away from the contact.

3. The linear compressor according to claim 2, wherein the first position is a bottom dead center (BDC) position of the piston, and at the BUG position of the piston, the refrigerant is drawn in though the inlet to be introduced into the cylinder.

4. The linear compressor according to claim 2, wherein, when the piston is at a second position during the reciprocating motion thereof; the support contacts or collides with the contact.

5. The linear compressor according to claim 4, wherein the second position is a top dead center (TDC) position of the piston, and at the TDC position of the piston, the refrigerant compressed within the cylinder is discharged our of the cylinder.

6. The linear compressor according to claim 2, wherein the magnet assembly further includes:

a cylindrical magnet frame; and a fixing plate fixed to a side of the magnet frame, and engaged with a second end of the permanent magnet.

7. The linear compressor according to claim 4, further including a flange that extends externally in a radial direction of the piston, wherein the flange approaches an end of the cylinder or moves away from the end of the cylinder, during the reciprocating motion of the piston.

8. The linear compressor according to claim 7, wherein, when the piston is at the first position, the flange is at a second distance away from the end of the cylinder, and wherein the first distance is less than the second distance.

9. The linear compressor according to claim 8, wherein, when the piston is at the second position, the flange is at a third distance away from the end of the cylinder, and wherein the third distance is less than the second distance.

10. The linear compressor according to claim 2, wherein, when the piston is at the first position, at least a portion of the support of the piston and the motor cover are at a second distance from each other in a radial direction.

11. The linear compressor according to claim 10, wherein, when the piston is at the second position, at least a portion of the support of the piston and the motor cover are at a third distance from each other in the radial direction, and wherein the third distance is equal to, or less than the second distance.

12. The linear compressor according to claim 1, wherein the contact is formed at a location where an imaginary line that extends from the permanent magnet meets the frame.

* * * * *